United States Patent [19]

Oida

[11] 4,021,345

[45] May 3, 1977

[54] CENTRIFUGAL DEHYDRATOR

[75] Inventor: Susumu Oida, Komaki, Japan

[73] Assignee: Tokyo Shibaura Electric Co., Ltd., Kawasaki, Japan

[22] Filed: June 30, 1976

[21] Appl. No.: 701,737

[30] Foreign Application Priority Data

July 3, 1975 Japan ..... 50-93245[U]
Aug. 11, 1975 Japan ..... 50-97308

[52] U.S. Cl. ..... 210/146; 192/136; 210/360 R; 210/368

[51] Int. Cl.[2] ..... B04B 1/00

[58] Field of Search ..... 210/360 R, 368, 146; 192/135, 136; 233/2

[56] References Cited

UNITED STATES PATENTS

| | | | |
|---|---|---|---|
| 1,882,123 | 10/1932 | Defibaugh | 192/136 |
| 2,004,064 | 6/1935 | Jordan et al. | 210/146 |
| 3,080,061 | 3/1963 | Forsberg | 210/146 X |
| 3,795,985 | 3/1974 | Hasbebe et al. | 192/136 X |

FOREIGN PATENTS OR APPLICATIONS

| | | | |
|---|---|---|---|
| 1,225,485 | 5/1960 | France | 210/146 |

*Primary Examiner*—Frank W. Lutter
*Assistant Examiner*—William A. Cuchlinski, Jr.
*Attorney, Agent, or Firm*—Cushman, Darby & Cushman

[57] ABSTRACT

Disclosed is a centrifugal dehydrator comprising an outer casing receiving therein a rotatable spin basket and having an opening for throwing therethrough articles or substances to be dehydrated into the basket, an outer lid swingably attached to the outer casing so as to open or close the opening, an inner lid located inside the outer lid so as to open or close the opening, a lock mechanism for locking the inner lid at a closed position, a switch mechanism for controlling a spin basket driving device and so designed that only when the inner lid is locked by the lock mechanism, the switch mechanism may be displaced up to a position at which it is capable of being turned on by the closed outer lid.

12 Claims, 16 Drawing Figures

CENTRIFUGAL DEHYDRATOR

This invention relates to a centrifugal dehydrator in which measures are taken for preventing the occurrence of dangers resulting from the rotation of a spin basket.

Generally, a centrifugal dehydrator is provided with a lid for opening and closing an opening intended to throw articles or substances to be dehydrated into a rotatable spin basket, said lid being so designed as to close for safety the opening during a period of time in which the spin basket is subject to high speed rotation by a motor. In this structure, the lid can be readily opened during a dehydration operation, so that there is a great danger that under a condition wherein the lid is opened an operator touches the spin basket under high speed rotation to get hurt.

To prevent such danger, another centrifugal dehydrator is proposed, which is provided with a switch mechanism and a brake mechanism operable in response to the movement of the lid, whereby when the lid is opened, the switch mechanism interrupts the power supply to a motor and simultaneously the brake mechanism brakes the spin basket. But, several seconds are required for the brake mechanism to completely stop the spin basket after the lid is opened, failing to sufficiently remove the above danger that the operator gets hurt. Further, since in the above-mentioned conventional structure, opening of the lid through only a small angle causes neither said switch mechanism nor said brake mechanism to operate, there is s danger of, for example, a little child putting his hand into a clearance resulting from such slight opening of the lid.

To prevent this, a centrifugal dehydrator is proposed in which lid means for opening or closing an opening for a spin basket is constructed into a so-called double lid structure having inner and outer lids and the inner lid is so designed as to be locked to its closed position by a lock mechanism. When, however, the operator forgets operating the lock mechanism or purposely leaves it unoperative because of troublesome (this often happens during the operation of the deydrator), the outer lid and the inner lid are able to be simultaneously opened, resulting in the occurrence of the above-mentioned danger. Further, when the inner lid is not locked, it taps the outer lid during the dyhydration operation to produce noises and in an extreme case causes the outer lid to jump, which is risky.

Accordingly, it is an object of the invention to provide a structurally simplified safe centrifugal dehydrator permitting removal of the above-mentioned danger at the time or opening the lid, by making operable a switch mechanism for motor only when the inner lid is locked to its closed position.

It is another object of the invention to provide said type of centrifugal dehydrator provided with means for keeping the inner lid at a locked condition while the spin basket is rotating due to its inertia.

Hereinafter, embodiments of the invention will be described by reference to the accompnying drawings in which.

Figure 1:
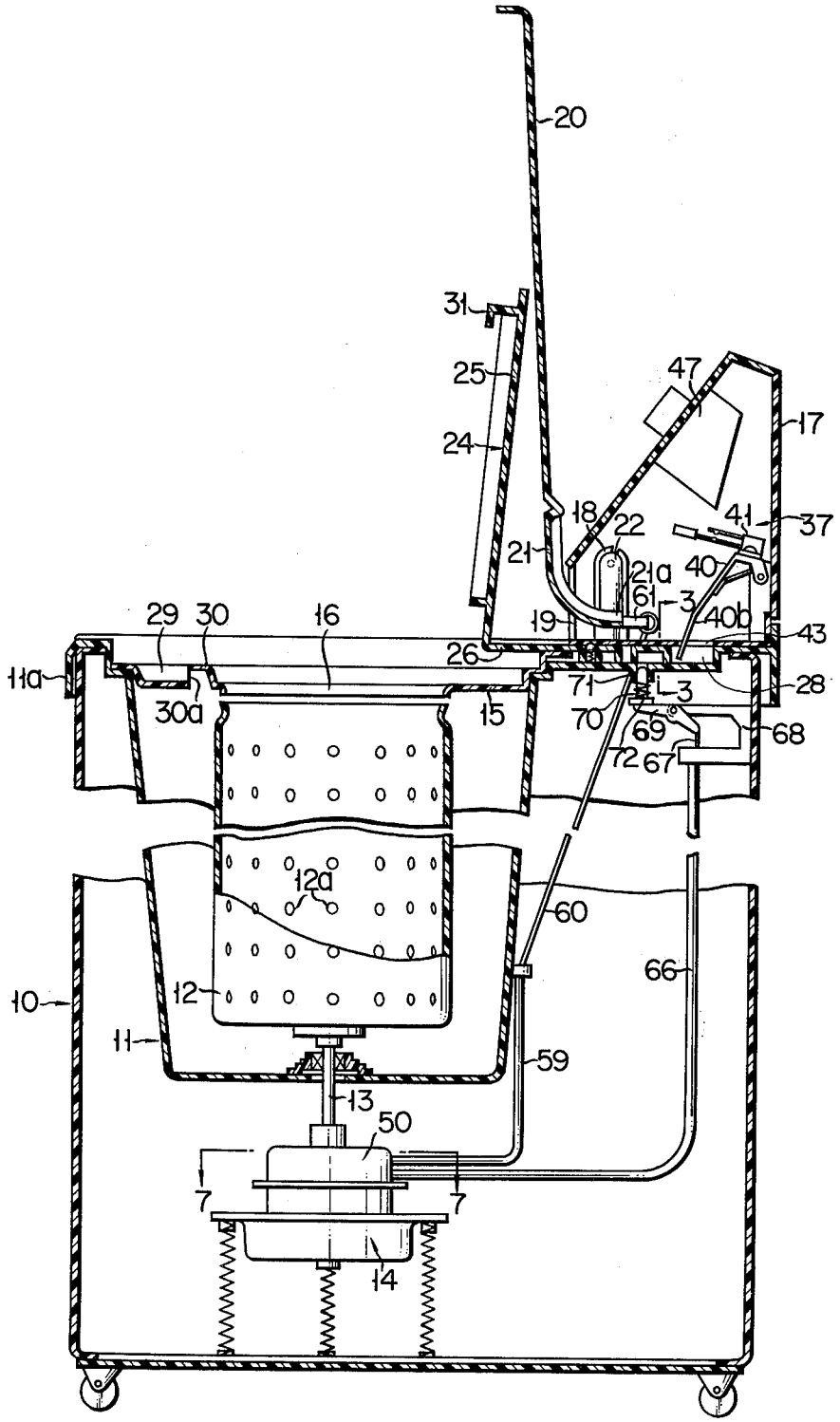
FIG. 1 is a longitudinal sectional view of a centrifugal dehydrator according to an embodiment of the invention, showing a condition in which both an inner lid and an outer lid are opened.

In FIG. 1, a numeral 10 denotes an outer casing, a numeral 11 a dehydration tank disposed within the outer casing 10 and having a flange **11*a* fixed to an upper end of the outer casing 10, and a numeral 12 a spin basket having a number of perforations 12*a* and rotatably supported within the dehydration tank 11 by a shaft 13. The spin basket 12 is designed to be rotated by a known electric motor 14 through the shaft 13. An upper plate 15 is fixed to the upper end of the dehydration tank 11. This upper plate constitutes part of the outer casing 10 and has at its substantially central part an opening 16 for throwing articles or substances to be dehydrated into the spin basket 12**.

A control box 17 is fixed to a rear end portion of the upper face of the tank 11. From an inner bottom wall of the control box 17 are upwardly extended a pair of supports 18 (In FIG. 1 only one is shown). An opening 19 is provided at the front face of the control box. An outer lid 20 has a curved hinge portion 21 at a central part of its rear section, said hinge portion being inserted into the control box 17 through the opening 19. From a rear end **21*a* of the hinge portion 21 are extended a pair of support arms 22 (In FIG. 1 only one is shown), which are rockably fitted to the supports 18 through pivots 23 (FIG. 5), respectively. Thus, an outer lid 20 is made swingable through the pivots 23 so as to open or close the opening 16**.

Figure 2:
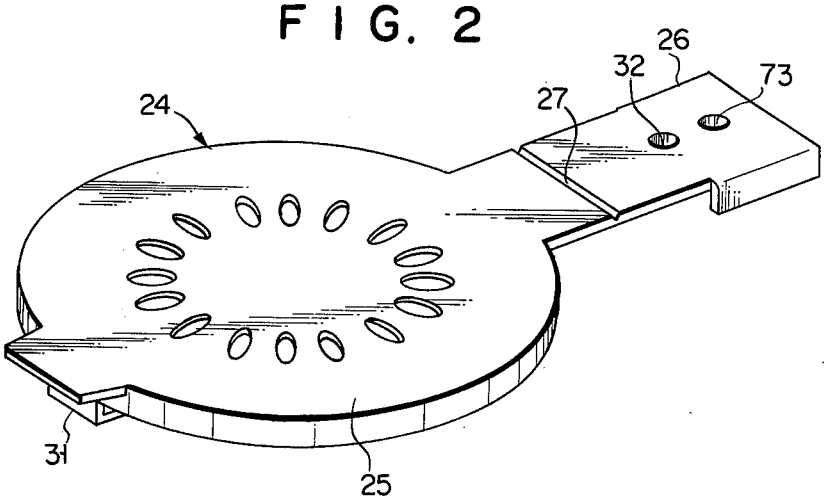
FIG. 2 is a perspective view of the inner lid shown in FIG. 1.
Figure 3:
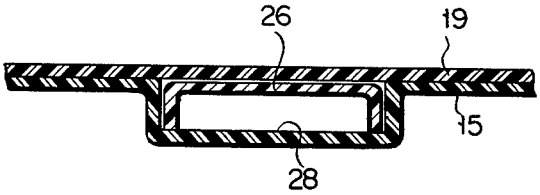
FIG. 3 is a sectional view on line 3—3 of FIG. 1.
Figure 4:
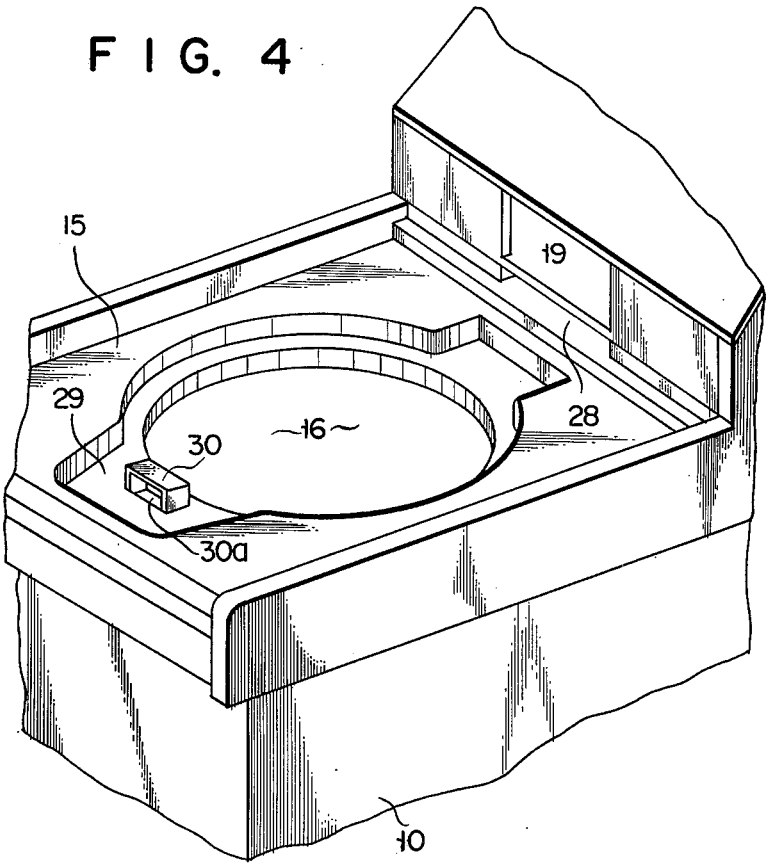
FIG. 4 is a perspective view of an upper-part of the dehydrator, showing a condition in which both of the inner lid and outer lid are removed.

Between the outer lid 20 and the upper plate 15 is disposed a second lid, i.e., inner lid 24 for opening or closing the opening 16 by being rocked within a region inside the outer lid 20. As shown in detail in FIG. 2, the inner lid 24 comprises a substantially circular lid body 25 and a tail member 26 integrally extending from the lid body rearwardly thereof, said lid body 25 being designed to be rockable about a V-shaped groove 27 provided between the lid body and the tail member. As seen from FIGS. 3 and 4, the upper rear portion of the tank 11 has a guide recess 28 right below a substantially central part of the control box 17, said tail member 26 of the inner lid 24 being slidably inserted into said guide recess 28. The upper plate 15 is formed at its upper face with a recess 29 substantially corresponding to the inner lid 24, and from a forward portion of the bottom wall of the recess 29 there integrally rises an engagement projection 30 having a bore 30*a* at its forward portion. At a forward end of the inner lid 24, namely, at the side opposite to the tail member 26, is integrally formed an engagement element or a hook 31, which, as later described, is engaged with the engagement projection 30 when the inner lid 24 closes the opening 16 and in sequence slides rearwards. In other words, the engagement projection 30 and the hook 31 constitute, in cooperation with each other, a lock mechanism for locking the inner lid 24 to its locked position.

Figure 5:
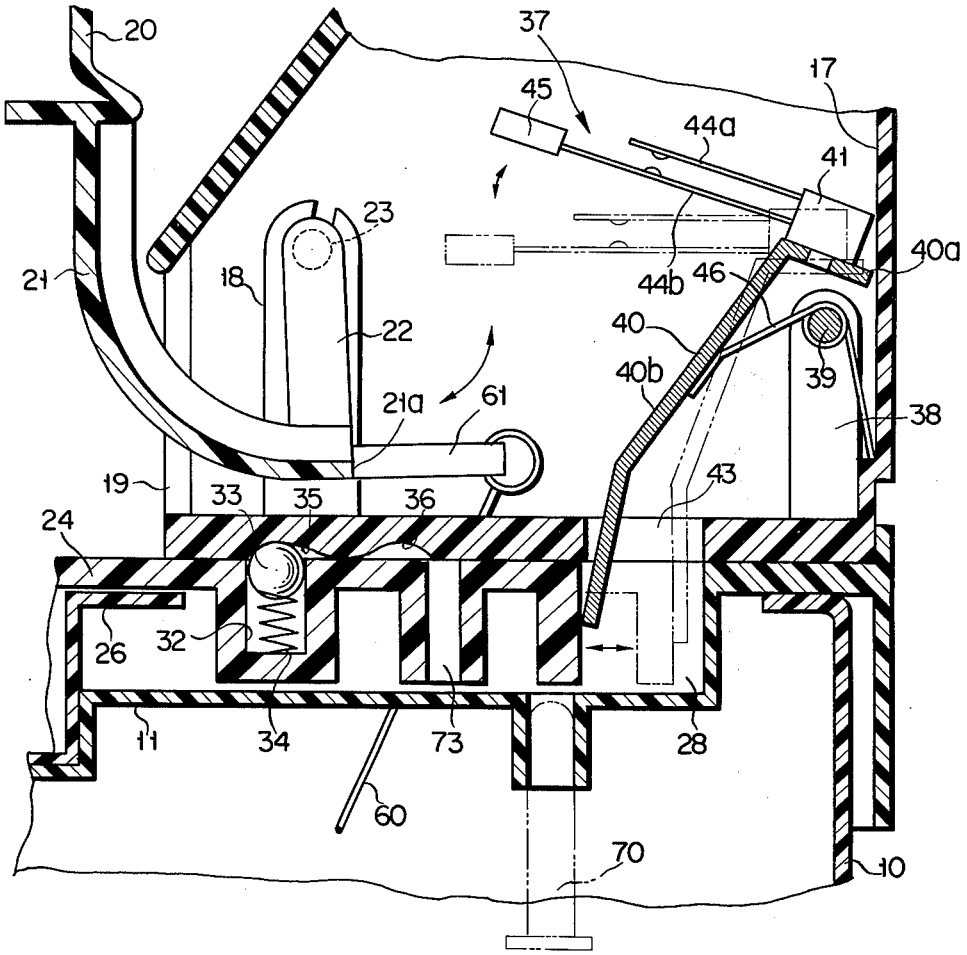
FIG. 5 is an enlarged sectional view of a tail portion of the inner lid and a switch mechanism.

As shown in detail in FIG. 5, the tail member 26 of the inner lid 24 is formed with a blind hole 32, which contains therein a ball 33 upwardly urged by a compression spring 34. In the lower side of the bottom wall of the control box 17 are formed a forward concave portion 35 and a rearward concave portion 36. The ball 33 is engaged with either one of the concave portions 35 and 36 in accordance with the position of the inner lid 24, thereby to hold the tail member 26 in place. For example, when the ball 33 is kept in engagement with the concave portion 36, the inner lid 24 is located at its locked position (FIG. 8) wherein the hook 31 is engaged with the engagement projection 30, while when the ball 33 is kept in engagement with the concave portion 35, the inner lid 24 is located at its unlocked position (FIGS. 1 and 9) wherein the hook 31 is disengaged from the engagement projection 30. The ball 33 is moved from one to the other of the concave portions 35 and 36 by strongly pushing or pulling the inner lid 24.

Figure 6:
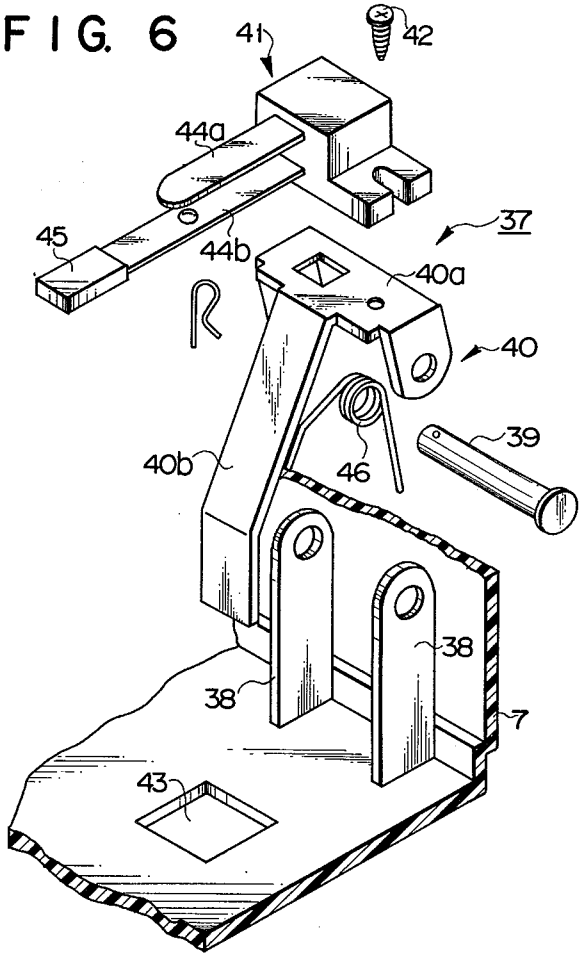
FIG. 6 is a perspective exploded view of the switch mechanism.
Figure 8:
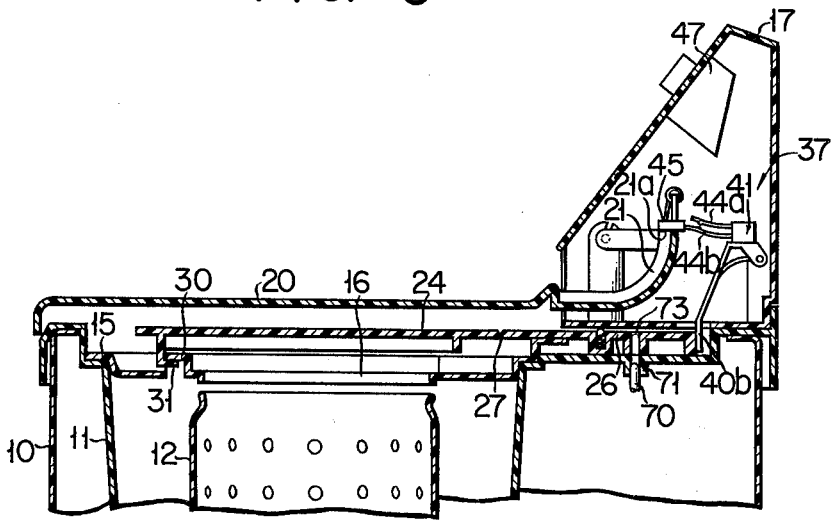
FIG. 8 is a longitudinal sectional view of the upper part of the dehydrator, showing a condition in which the inner lid is located at its locked position.
Figure 9:
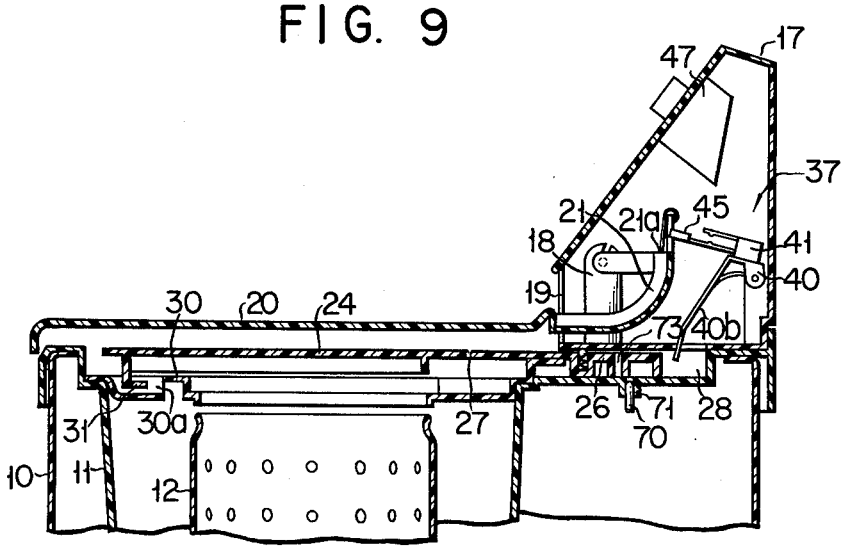
FIG. 9 is a view similar to FIG. 8, showing a condition in which the inner lid is located at its unlocked position.

As shown in detail in FIGS. 5 and 6, the centrifugal dehydrator according to the invention is provided with a switch mechanism 37 displaceable in accordance with the position of the inner lid. The switch mechanism is provided with a lever member 40 rockably supported, by a pin 39, on a pair of supports 38 extending from the bottom wall of the control box 17, and a switch 41 fixed to an upper end of a pivotal support section 40*a* of the lever member 40 through a screw 42. The switch 41 is connected to a known control circuit (not shown) for the motor 14 together with a known timer 47 (FIG. 1) provided for the control box 17, said control circuit being closed only when both of the switch 41 and the timer 47 are operated. The lever member 40 has a lever portion 40*b*, which integrally extends from the pivotal support portion 40*a*, and has its tip end inserted into the guide recess 28 thorough an opening 43 formed in the bottom wall of the control box 17. Thus, the tip end of the lever portion 40*b* is situated within the guide recess 28 rearwardly of the tail member 26 of the inner lid 24. The switch 41 has a pair of contact arms 44*a*, 44*b* extending in parallel. The lower contact arm 44*b* extends longer than the upper arm 44*a* and has at its tip end an abutment block 45 made of insulation material. A coil spring 46 provided for the pin 39 has one spring arm thereof engaged with the rearward inner wall of the control box 17 and has the other spring arm engaged with the lever portion 40*b* of the lever member 40 to urge the lever member 40 and thus the switch 41 clockwise of FIG. 5. The lever portion 40*b* of the lever member 40 is pivotally moved in accordance with the position of the inner lid 24 to permit the swtich 41 to move between the following two positions. Namely, when the inner lid 24 is located at a solid line-indicated position of FIG. 5, i.e., at its unlocked position, the lever member 40 is urged clockwise by the coil spring 46 to permit the swtich 41 to be brought to a solid line-indicating position of FIG. 5, i.e., an inoperable position. The abutment block 45 of the switch 41 is so arranged as to be located outside the moving range of the rear end 21*a* of the hinge portion 21 of the outer lid 20 when the swtich 41 is located at this inoperative position. For this reason, as shown in FIG. 9, even when the outer lid 20 is closed, the switch 41 is kept inoperative. On the other hand, when the inner lid 24 is moved to its locked position, i.e., a chain line-indicated position of FIG. 5, the tail member 26 of the inner lid 24 causes the lever portion 40*b* of the lever member 40 to be moved counterclockwise against the biasing force of the coil spring 46, thereby to permit the switch 41 to be brought to a chain line-indicated position of FIG. 5, i.e., an operable position. When the switch 41 arrives at this position, the abutment block 45 reaches a position (FIG. 8) at which the rear end 21*a* of the hinge portion of the closed outer lid 20 is capable of abutting on the block 45, so as to permit contact points of the contact arms 44*a*, 44*b* to be brought into contact with each other.

In this way, the switch 41 can be operated by the outer lid 20 only when the inner lid 24 is locked.

Figure 7:
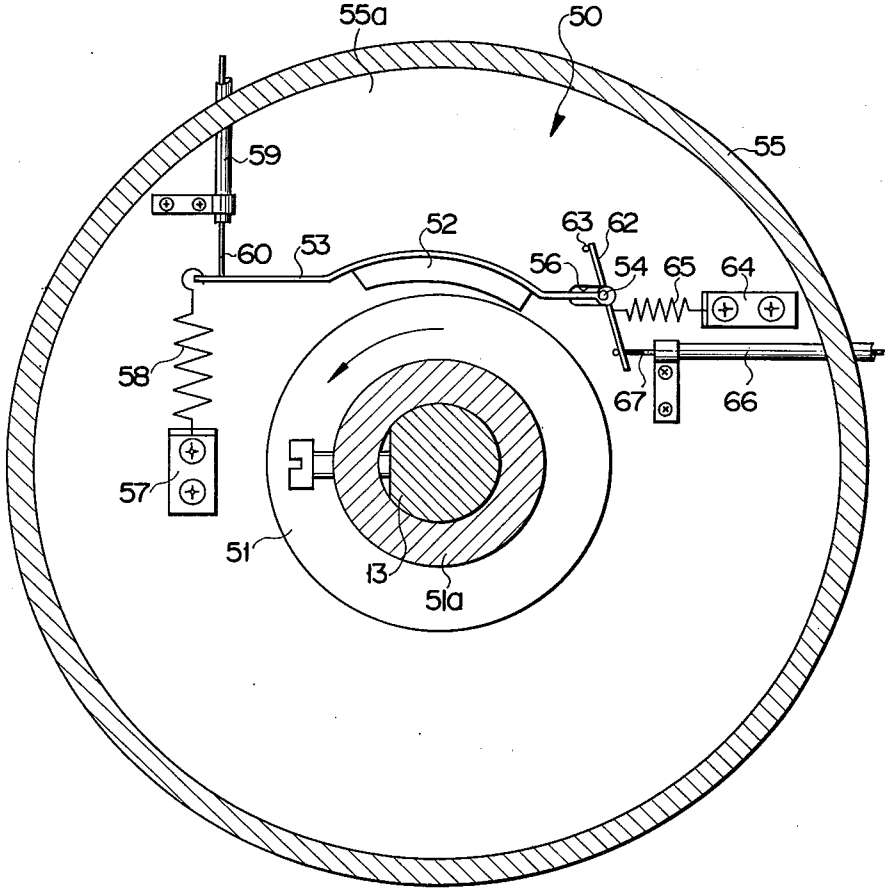
FIG. 7 is a sectional view on line 7—7 of FIG. 1, showing the brake mechanism.

The centrifugal dehydrator is further provided with a brake mechanism 50 (FIGS. 1 and 7) for braking the spin basket 12 when the outer lid 20 is opened. As shown in detail in FIG. 7, the brake mechanism 50 includes a brake drum 51 fixed to the shaft 13 through a boss section 51*a* so as to be rotatable integrally with the shaft 13 and a support lever 53 supporting a brake shoe 52 for frictionally engaging the outer periphery of the brake drum. The support lever 53 at one end a vertical pivot pin 54, which is inserted into an elongate guide slot 56 formed in a bottom plate 55*a* of a casing 55. Between the other end of the support lever 53 and a lug 57 mounted on the bottom plate 55*a* is stretched a tension spring 58, which urges the support lever 53 so as to press the brake shoe 52 against the brake drum 51. To said other end of the support lever 53 is fixed one end of a wire 60 received in a sheath 59, the other end of said wire 60 being fixed to protrusion 61 (FIGS. 1 and 5) extending from the rearward end of the outer lid 20. When the outer lid 20 is closed as shown in FIGS. 8 or 9, the wire 60 pulls the support lever 53 against the biasing force of the spring 58 to disengage the brake shoe 52 from the brake drum 51 (FIG. 7). In contrast, when the outer lid 20 is opened as shown in FIG. 1, the wire 60 is loosened and the tension spring 58 causes the support lever 53 to be pivotally moved about the pin 54 counterclockwise of FIG. 7 so as to cause the brake shoe 52 to be pressed against the brake drum 51. From the vertical pivot pin 54 is extended an elongate rod 62 in a horizontal direction, one end of said rod 62 being allowed to abut against a stop pin 63 rising from the bottom plate 55*a*. Between an intermediate portion of the rod 62 and a lug 64 mounted on the bottom plate 55*a* is stretched a tension spring 65, which urges the vertical pivot pin 54 toward one end of the guide slot 56, namely, toward the right end of FIG. 7. To the other end of the rod 62 is connected one end of a wire 67 received in a sheath 66, the other end of said wire being connected, as shown in FIG. 1, to one end of a lever 69 pivotally supported by a bracket 68 fixed to the outer casing 10. A stop pin 70 is mounted on the other end of the lever 69. This stop pin 70 is slidably inserted into a guide hole 71 formed in the upper rear portion of the tank 11 and is downwardly biased by a compression spring 72. Said tail member 26 of the inner lid 24 is bored with a lock hole 73 (FIG. 5), which is arranged, when the inner lid 24 is located at its locked position of FIG. 8, to coincide with said guide hole 71. Again in FIG. 7, when the brake shoe 52 is brought into frictional engagement with the brake drum 51 under rotation made counterclockwise of FIG. 7, the support lever 53 is shifted counterclockwise by a frictional force produced between the brake shoe 52 and the brake drum 51, thereby to cause the vertical pivot pin 54 to be pulled toward the left end of the slot 56. Therefore, the rod 62 is clockwise rocked about the stop pin 63 against the tension spring 65 to pull the wire 67. As a result, the wire 67 causes the lever 69 to be rocked clockwise of FIG. 1 to push up the stop pin 70. If, at this time, the lock hole 73 is in coincidence with the guide hole 71, the stop pin 70 enters the lock hole 73 to unmovably hold the tail portion 26, accordingly the inner lid 24 in position. When the shaft 13, accordingly, the brake drum 51 is stopped, the frictional force having theretofore acted between the brake shoe 52 and the brake drum 51 is lost, and the rod 62 is returned to a position of FIG. 7 by the biasing force of the tension spring 65. For this reason, the wire 67 is loosened with the result that the stop pin 70 is disengaged from the lock hole 73 due to the biasing force of the compression spring 72.

The operation of this embodiment will now be explained.

As shown in FIG. 1, the outer lid 20 and the inner lid 24 are opened, and articles or substances to be dehydrated (not shown) are thrown into the spin basket 12 through the opening 16. When the inner lid 24 closes the opening 16 and then is pushed rearwardly, i.e., toward the right of FIG. 1, the hook 31 of the inner lid 24 is brought into engagement with the engagement projection 30 to permit the inner lid to be kept at its locked condition and simultaneously to permit the tail member 26 of the inner lid to be pressed against the lever portion 40*b* of the lever member 40 to cause the switch 41 to be pivotally moved to its operable position. When, subsequently, the outer lid 20 closes the opening 16 from above the inner lid 20, the rear end 21*a* of the outer lid is allowed to abut on the abutment block 45 to close the swtich 41 (FIG. 8) and simultaneously the wire 60 causes the brake shoe 52 to be disengaged from the brake drum 51 (FIG. 7). When, under this condition, the timer 47 is set, the motor 14 is driven by the control circuit (not shown) to permit the spin basket 12 to be rotated.

When the outer lid 20 is opened after completion of the dehydration operation or during the dehydration operation, the rear end 21*a* of the outer lid 20 is separated from the abutment block 45 to cause the swtich 41 to be turned off and simultaneously the brake shoe 52 causes a brake force to act on the brake drum 51. At this time, as previously stated, the stop pin 70 enters the lock hole 73 of the tail member 26. For this reason, during a period of time in which the spin basket 12 continues to rotate due to inertia, the inner lid 24 is maintained located at its locked position by the stop pin 70 to be prevented from moving toward its position for releasing the engagement between the hook 30 and the engagement projection 31. When the rotation of the spin basket 12 is stopped, the stop pin 70 is disengaged from the lock hole 73 as previously mentioned. Therefore, the inner lid 24 is pulled to the unlocked position to cause the hook 30 to be disengaged from the engagement projection 31, and simultaneously to cause the swtich to be brought to the inoperable position shown in solid line in FIG. 5. At this point of time, the inner lid 24 is opened so as to permit the dehydrated articles or substances to be taken out from the spin basket 12.

In contrast, as shown in FIG. 9, where the operator forgets moving the inner lid 24 to the locked position, the hook 30 is disengaged from the engagement projection 31 and accordingly the tail member 26 of the inner lid 20 is not pressed against the lever portion 40*b* of the lever member 40. As a result, the switch 41 is kept located at its inoperable position by the coil spring 46, and, even when the outer lid 20 is closed, is not turned on by the outer lid. Therefore, even if the timer 47 is set, this will not make the control circuit (not shown) operative and accordingly the motor 14 will not also be driven. But if the operator remembers keeping the inner lid 24 unlocked and moves it to the locked position, the dehydrator will be brought, as shown in FIG. 8, to a state wherein it is operable by the timer 47.

As above described, in the present centrifugal dehydrator, the motor 14 is brought to a drivable state only when the inner lid 24 has been moved to its locked position. For this reason, the danger is eliminated that, during the dehydration operation, the inner lid 24 is shaked due to the vibration or abruptly jumps. When it is desired to take out the articles or substances to be dehydrated from the spin basket 12, the steps of first opening the outer lid 20 and then unlocking the inner lid 24 and finally opening the inner lid 24 are required. Therefore, during these steps, the rotation speed of the spin basket 12 is sufficiently slowed down to remove the conventional danger that the operator may get hurt due to the inertia rotation of the spin basket. Further, where, as in the above-mentioned embodiment, the stop pin 70 for preventing the unlocking of the inner lid 24 while the spin basket 12 is rotating due to its inertia is disposed, the above-mentioned danger can be more reliably removed.

FIGS. 10 to 13 show the centrifugal dehydrator according to another embodiment of the invention. In this embodiment, other parts and sections than the inner lid and the associated parts are substantially the same as those of the preceding embodiment. Therefore, the same parts and sections are denoted by the same reference numerals and a description thereof is omitted. Further, since the brake mechanism of this embodiment is the same as that of the preceding embodiment, it is omitted from the associated figures.

Figure 10:
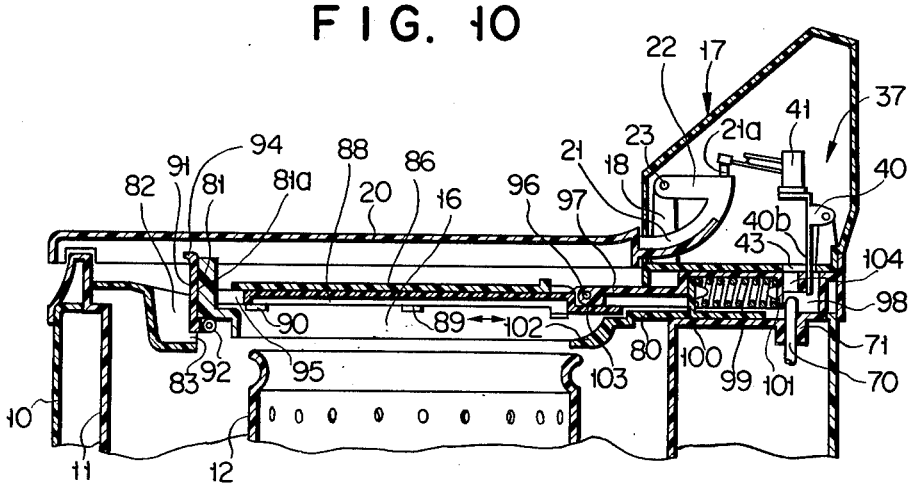
FIG. 10 is a longitudinal sectional view of the centrifugal dehydrator according to another embodiment of the invention, showing a condition in which the inner lid is located at its locked position.
Figure 11:
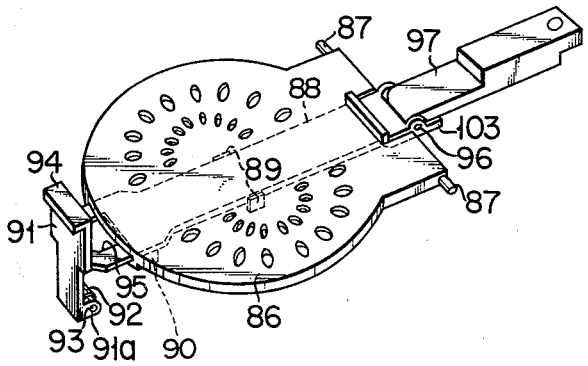
FIG. 11 is a perspective view of an inner lid shown in FIG. 10.
Figure 12:
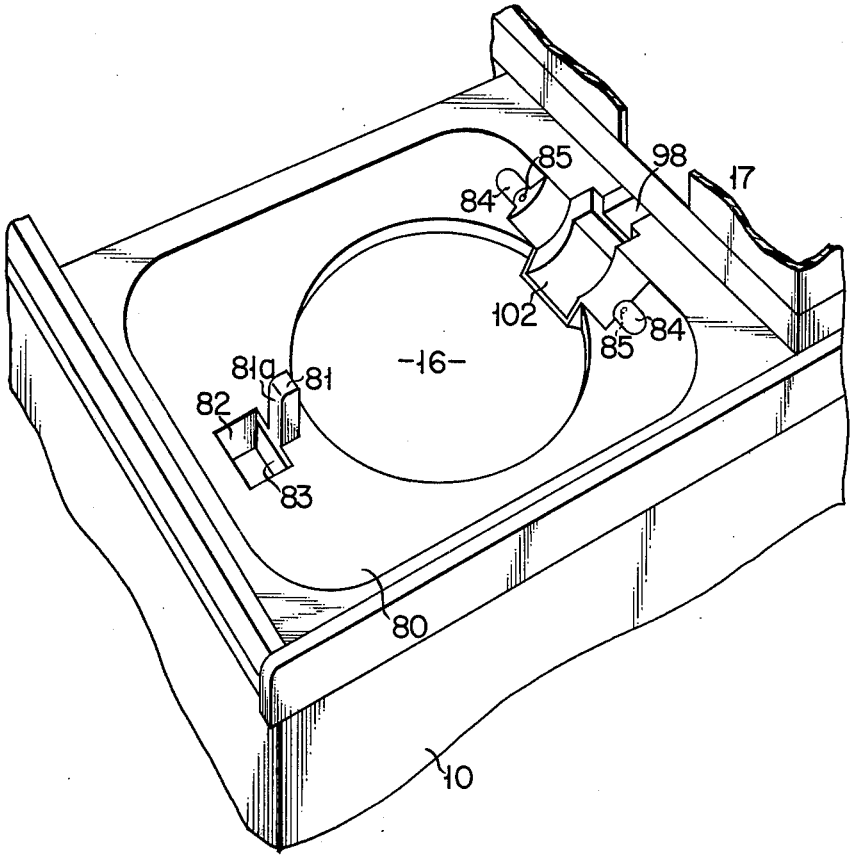
FIG. 12 is a perspective view of an upper part of the dehydrator shown in FIG. 10, showing a condition in which both of the inner lid and outer lid are removed.
Figure 13:
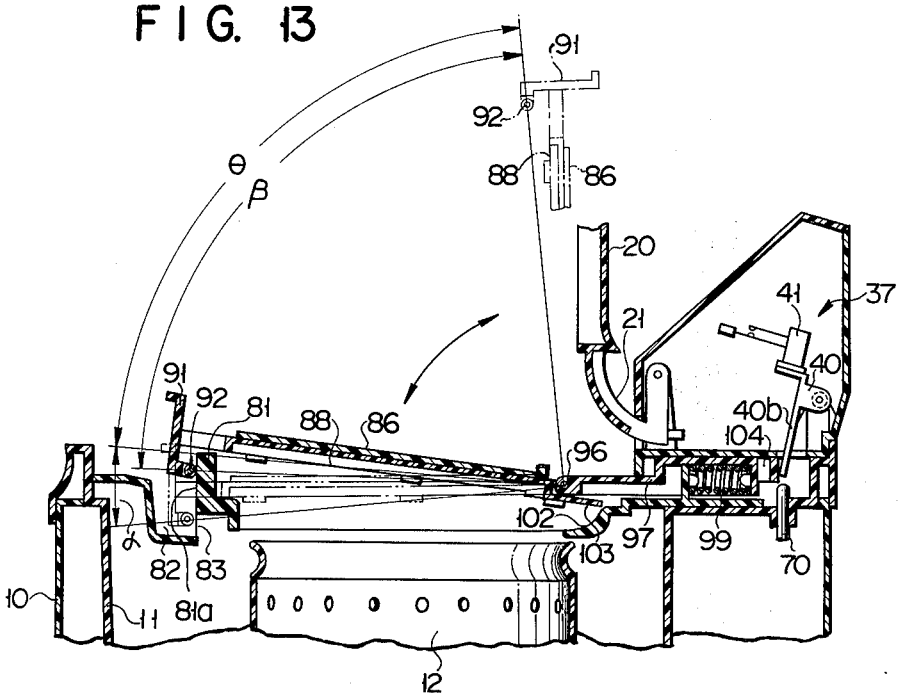
FIG. 13 is a view similar to FIG. 10, showing a condition in which the inner lid is located at its unlocked position.

As shown in FIGS. 10 and 12, an upper plate 80 fixed to the upper end of the deydration tank 11 has an engagement projection 81 at a forward portion of the opening 16, and a forward or front face of the engagement projection forms a first guide face 81*a* extending upwards by a prescribed length. Just in front of the engagement projection 81 is provided an escapement recess 82, which communicates with an engagement hole 83 right below the engagement projection 81. As shown in FIG. 12, the upper plate 80 has a pair of support portions 84 at positions located back of the opening 16, respectively, said pair of support portions being bored with a pair of round pivot holes 85, respectively. As shown in FIG. 11, the inner lid 86 of this embodiment has a pair of pivot pins 87 extending crosswise from both sides of its rear end, respectively, said pair of pivot pins 87 being rockably supported by said pair of pivot holes 85. For the inner lid 86 is provided a slide member 88, which is held in place so as to be moved longitudinally of the inner lid 86 by two pairs of lugs 89, 90 mounted on the underside of the inner lid. On a forward end of the slide member 88 is integrally formed a downwardly extending engagement portion 91, from a lower end of which are rearwardly extending a pair of projections 91*a* (In FIG. 11 only one is shown). Between both projections is rotatably retained by a pin 93 a roller 92 acting as a hook. From the engagement portion 91 is upwardly integrally extended a hundle grip 94. The slide member 88 further has just at the back of the engagement portion 91 an engagement hole 95 for permitting free passage therethrough of the engagement projection 81.

To a rear end of the slide member 88 is rockably connected through a pin 96 a tail member 97, which is movably inserted into a guide recess portion 98 formed between the upper plate 80 and the control box 17 as in the case of the tail member 26 of the preceding embodiment. A compression spring 99 (FIG. 10) is interposed between a upright portion 100 of the upper plate 80 and a falling portion 101 of the tail member 97 to urge or bias the tail member 97, accordingly the slide member 88 rearwardly thereof, namely toward the locked position thereof.

Between the pair of support portions 84 of the upper plate 80 is formed a second guide face 102 (FIGS. 10 and 12) describing a circular arc with the pivot hole 85 as a center. On the other hand, on the rear end of the slide member 88 is integrally formed an engagement piece 103 rearwardly extending by a prescribed length. A rear end of the engagement piece 103 is so set that when the slide member 88 is pulled forwards against the biasing force of the compression spring 99, namely when the pin 96 is brought into alignment with the pivot pins 87, it is located on an imaginary extended circular arc of the guide face 102.

Said engagement projection 81, first guide face 81*a*, engagement portion 91, roller 92, second guide face 102, and engagement piece 103 have the following relative positions, respectively. As shown in FIG. 10, when the roller 92 of the engagement portion 91 is disengaged from the first guide face 91*a* of the engagement projection 91 and engaged with the engagement hole 83, the slide member 88 is urged rearwards due to the action of the compression spring 99 to be held at the position at which the roller 92 is engaged with the engagement hole 83, namely at the locked position of the inner lid 86. At this time, the engagement piece 103 is desengaged from the second guide face 102. On the other hand, as shown in two-dot chain lines in FIG. 13, when the slide member 88 is forwardly moved against the compression spring 99 jointly with the tail member 97, the roller 92 is disengaged from the engagement hole 83 to be brought to an upwardly clockwise rockable condition. While the slide member 88 is rocked about the pivot pin 96 through an angle of $\alpha$ from a two-dot chain line indicated position of FIG. 13, the roller 92 rolls on the first guide face 81*a* to keep the tail member 97 located at the forward position. When the inner lid 86 has arrived at a solid line-indicated position of FIG. 13 during the period in which the roller 92 rolls on the first guide face 81*a*, the rear end of the engagement piece 103 starts to abut against the second guide face 102 and, until the inner lid 86 is thereafter brought to a one-dot chain line-indicated position of FIG. 13 or a fully opened position, is allowed to slide on the second guide face 102 while being rocked through an angle of $\beta$. For this reason, while the engagement piece 103 is being guided by the second guide face 102, the tail member 97 is kept located at the forward position. As seen from FIG. 13, the angle of $\alpha$ through which the roller 92 rolls on the first guide face 81*a* is partially overlapped on the angle of $\beta$ through which the engagment piece 103 slides on the second guide face 102. As a result, except for the time when the roller 92 is in engagement with the engagement hole 83, namely, except for the time when the inner lid 86 is located at the locked position (FIG. 10), the tail member 97 is necessarily kept located at the forward position against the biasing force of the compression spring 99 through the engagement of the roller 92 with the first guide face 81*a* and/or through the engagement of the engagement piece 103 with the guide face 102.

On a rearward upper face of the upper plate 80 is fixed a control box 17, within which is disposed a switch mechanism 37 similar to that of the preceding embodiment. A lever portion 40*b* of the lever 40 is inserted into a guide groove 98 through an opening 43 and thus located rearwardly of the tail member 97. When, as in FIG. 10, the tail member 97 is located at the rearward position, the lever portion 40*b* permits the swtich 41 to be kept located at a position operable by the rear end 21*a* of the outer lid 20. But, on the contrary, when, as in FIG. 13, the tail member 97 is located at the forward position, the lever portion 40*b* permits the switch 41 to be kept located at a position inoperable by the outer lid 20.

In the neighbourhood of the rear ene of the tail member 97 is provided a lock hole 104 similar to the hole 73 of the preceding embodiment, while in the upper portion of the dehydration tank 11 is formed a guide hole 71 receving therein a stop pin 70. The stop pin 70 operates in response to the brake mechanism (not shown) as in the case of the preceding embodiment. To the outer lid 20 is connected a wire (not shown) for controlling the brake mechanism (not shown) as in the case of the wire 60 of the preceding embodiment.

The operation of this embodiment is as follows.

After articles or substances to be dehydrated have been thrown into the spin basket 12 from the opening 16 under the condition wherein the outer lid 20 and the inner lid 86 are opened, the inner lid 86 starts to be closed. The roller 92 is first allowed to roll on the first guide face 81*a* of the engagement projection 81 and then is engaged with the engagement hole 83 by the biasing force of the compression spring 99 to cause the inner lid 86 to be locked. Simultaneously, the tail member 97 is moved to the rearward position to push or urge the lever portion 40*b* of the switch mechanism 37 thereby to cause the switch 41 to be brought to the operable position. At this time, the lock hole 104 is brought into alignment with the guide hole 71. When, subsequently, the outer lid 20 is closed, the switch 41 is turned on and, as the timer 47 is set, the motor (not shown) starts to drive the spin basket 12.

When the outer lid 20 is opened, the switch 41 is turned off to cut off the power supply to the not shown motor and simultaneously the not shown brake mechanism is operated. At this time, the stop pin 70 is allowed to rise by means of the lever 69 to enter the lock hole 104 to keep the tail member 97, accordingly the inner lid 86 located at the locked position. When the motor rotation is stopped, the stop pin 70 escapes from within the lock hole 104 to permit the inner lid 86 to be brought to a condition ready for opening.

In the case of this embodiment, mere closing of the opening 16 is sufficient to cause the inner lid 86 to automatically reach its locked position owing to the biasing force of the compression spring 99. When the inner lid is located at its unlocked position, the tail member 97 is kept at a position wherein the swtich mechanism 37 is always maintained at an inoperable condition by a first guide mechanism composed of the roller 92 and the first guide face 81*a* and/or a second guide mechanism composed of the engagement piece 103 and the second guide face 102. To dispose two such guide mechanisms is very practical and advantageous where consideration is given to the rocking operation of the inner lid 86.

Figure 14:
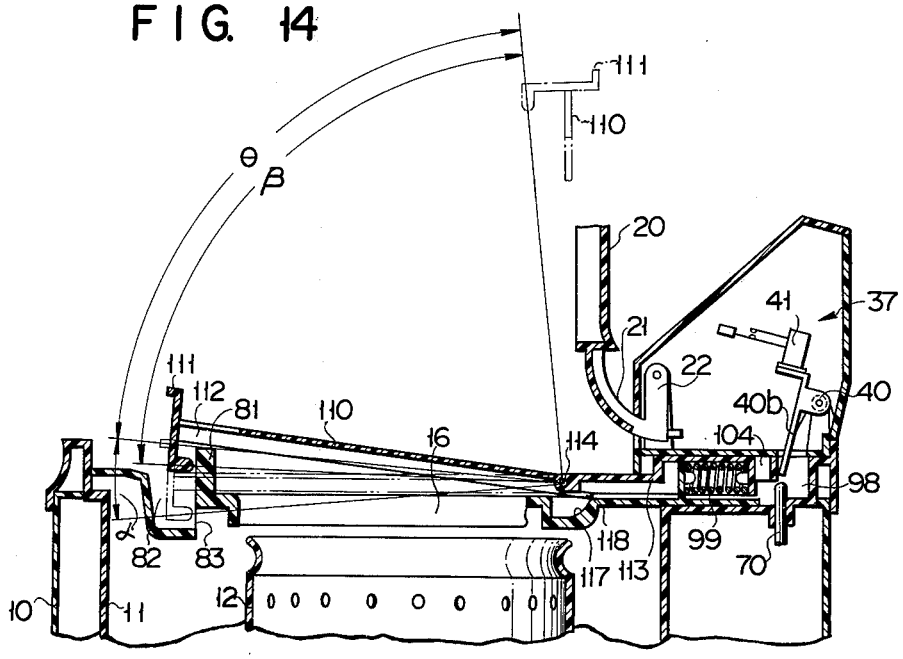
FIG. 14 is a view similar to FIG. 13, showing a modification of the centrifugal dehydrator according to said another embodiment of the invention.
Figure 15:
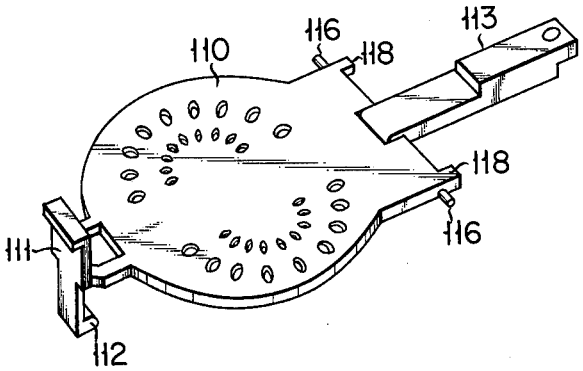
FIG. 15 is a perspective view of the inner lid shown in FIG. 14.
Figure 16:
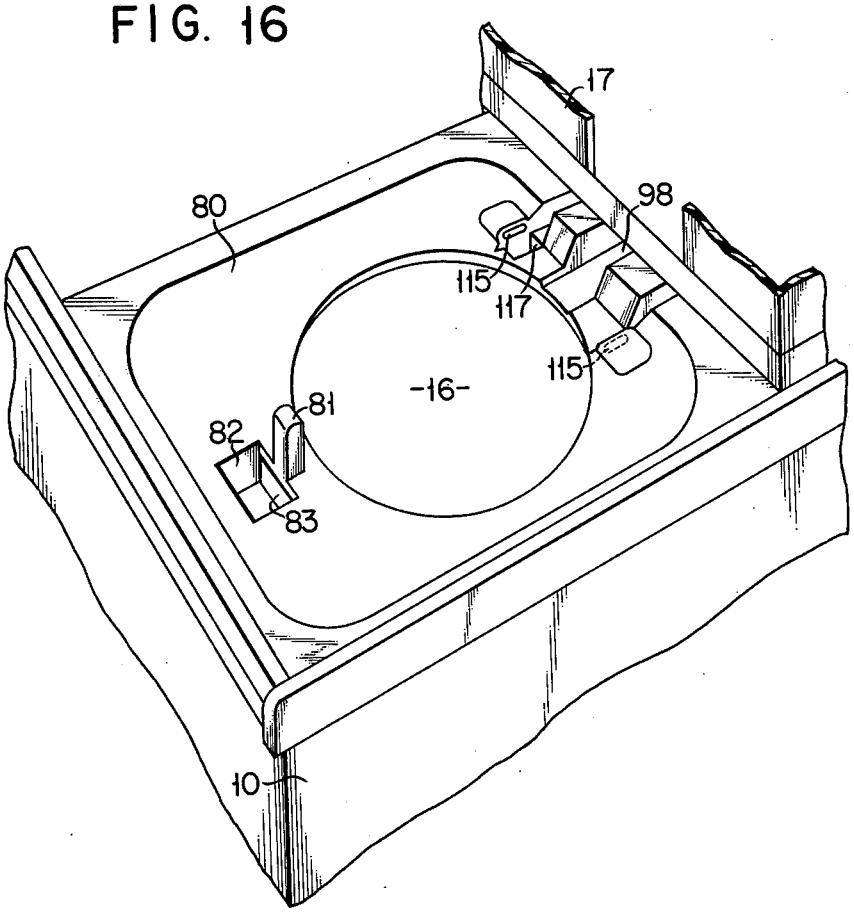
FIG. 16 is a perspective view of an upper part of the centrifugal dehydrator shown in FIG. 14, showing a condition in which both of the inner lid and outer lid are removed.

FIGS. 14 to 16 show a modification of the inner lid according to the above-mentioned second embodiment of the invention. In this modification, an inner lid 110 has not such a member as the slide member 88 of the second embodiment, and an engagement portion 111 is provided directly integrally with the forward end of the inner lid 110. The lower end of the engagement portion 111 is projected rearwardly to form a hook 112. A tail member 113 is rockably attached to the rear end of the inner lid 110 through a pivot 114 (FIG. 14). The upper plate 80 is formed with a pair of elongate pivot holes 115 in replacement of said round pivot holes 85. From both sides of the rear end of the inner lid 110 are laterally extended a pair of pivot pins 116 being in alignment with the pivot 114, respectively. The pins 116 are respectively inserted into the pair of pivot holes 115 so as to be movable longitudinally thereof. In the proximity of the pair of the pivot holes 115 are formed a pair of second guide faces 117 (In FIG. 16, only one is shown), respectively, which describe circular arcs with the front end of the pivot holes 115 as centers, respectively. Further, on the rear end of the inner lid 110 are integrally provided a pair of engagement pieces 118 for being engaged with the second guide faces 117, respectively.

In this modification, when the hook 112 is engaged with the engagement hole 83, namely when the inner lid 110 is kept locked, the inner lid 110 is kept rearwardly urged jointly with the tail member 113 by the compression spring 99. At this time, the tail member 113 permits the switch mechanism 37 to be kept located at a position operable by the outer lid 20, and the pivot pins 116 are located at the rear ends of the pivot holes 115, respectively. When the inner lid 110 is pulled forwards as indicated in two-dot chanin lines in FIG. 14, the tail member 113 is forwardly moved against the biasing force of the compression spring 99 to cause the switch mechanism 37 to be brought to an inoperable position. Further, at the time, the pivot pins 116 are moved up to the front ends of the pivot holes 115, respectively. When the inner lid 110 is upwardly rocked, the tail member 113 is kept located during the rocking movement through an angle of $\alpha$, at the forward position by engagement of the hook 112 with the first guide face 81, and simultaneously similarly kept located, during the rocking movement through an angle of $\beta$, at the forward position by engagement of the engagement pieces 118 with the second guide faces 117. Also in the case of the modification, the angles of $\alpha$ and $\beta$ are partially overlapped on each other similarly to the second embodiment.

The construction of the other parts or sections, and the operation, of this modification are substantially the same as those of the second embodiment, and therefore no further description is made.

What is claimed is:

1. A centrifugal dehydrator comprising an outer casing having an opening, a spin basket rotatably disposed within said casing and faceing said opening, a motor for driving said spin basket, an outer lid swingably mounted on said outer casing so as to open or close said opening, an inner lid swingably mounted on said outer casing so as to open or close said opening inside the outer lid, a lock mechanism for locking said inner lid to a closed condition, and a switch mechanism for actuating said motor and associated with said inner lid so that only when said inner lid is locked by said lock mechanism, the switch mechanism is displaced to an operable position capable of being turned on by the closed outer lid.

2. A centrifugal dehydrator according to claim 1, wherein said lock mechanism is composed of an engagement member provided for said outer casing adjacent to said opening, and an engaging member provided for said inner lid and engageable with said engagement member so as to permit and inner lid to be kept locked and disengageable from said engagement member so as to permit said inner lid to be kept unlocked.

3. A centrifugal dehydrator according to claim 2, wherein said inner lid body for directly opening or closing said opening, and a tail member movable between a first position permitting said switch mechanism to be displaced to an operable position and a second position permitting said switch mechanism to be displaced to an inoperable position, said tail member being connected to said lid body so that when said engaging member is engaged with said engagement member, said tail member is moved to said first position.

4. A centrifugal dehydrator according to claim 3, which further comprises spring means for urging said tail member to said first position.

5. A centrifugal dehydrator according to claim 4, which further comprises guiding means for permitting said tail member to be kept located at said second position against the biasing force of said spring means except for the time when said inner lid is located at the locked position.

6. A centrifugal dehydrator according to claim 4, wherein said inner lid has a slide member provided for said lid body so as to be movable longitudinally thereof, one end of said slide member being pivotally connected to said tail member so as to be movable longitudinally thereof and intergrally therewith, the other end of said slide member having said engaging member fixed thereto.

7. A centrifugal dehydrator according to claim 6, which further comprises first guiding means for, in a moving process wherein said inner lid is unlocked and pivotally moved in a direction in which said inner lid is opened, permitting said tail member to be kept at said second position against the biasing force of said spring means during a period of time in which said inner lid is rocked through an initial prescribed angle of the pivotal movement, and second guiding means for permitting said tail member to be kept at said second position against the biasing force of said spring means during a period of time in which said inner lid is rocked through the remaining angle of the pivotal movement.

8. A centrifugal dehydrator according to claim 7, wherein said second guiding means is so arranged as to start to be made effective during a period of time in wich said first guiding mens is still effective.

9. A centrifugal dehydrator according to claim 8, wherein said first guiding means is composed of said engaging member and a first guide face extending from said engagement member by a prescribed length and engageable with said engaging member during the period of time in which said inner lid is rocked through said initial prescribed angle of the pivotal movement.

10. A centrifugal dehydrator according to claim 9, wherein said second guiding means is composed of an engaging stop member extending from said one end of said slide member, and a second guide face formed on the outer casing so as to start to be engaged with said engaging stop pin during a period of time in which said engaging member is still engaged with said first guide face.

11. A centrifugal dehydrator according to claim 1, which further comprises a brake mechanism for braking said spin basket when said switch mechanism is turned off.

12. A centrifugal dehydrator according to claim 11, which further comprises a stop mechanism for fixing said inner lid to the locked position in response to a frictional force applied to said brake mechanism during a period of time in which said spin basket rotates due to inertia.

* * * * *

UNITED STATES PATENT AND TRADEMARK OFFICE

CERTIFICATE OF CORRECTION

PATENT NO. : 4,021,345

DATED : May 3, 1977

INVENTOR(S) : Oida

It is certified that error appears in the above-identified patent and that said Letters Patent are hereby corrected as shown below:

Claim 1, line 3, correct the spelling of "facing".

Claim 2, line 6, delete "and" and insert --said--.

Claim 3, line 2, after "inner lid", insert --includes a lid--.

Signed and Sealed this

*Seventeenth* Day of *July 1979*

[SEAL]

*Attest:*

*Attesting Officer*

LUTRELLE F. PARKER

*Acting Commissioner of Patents and Trademarks*